United States Patent [19]

Buford

[11] Patent Number: 4,752,029

[45] Date of Patent: Jun. 21, 1988

[54] CARTON WITH INTEGRAL DISPLAY BIN

[75] Inventor: John C. Buford, Madison, Wis.

[73] Assignee: Manville Corporation, Denver, Colo.

[21] Appl. No.: 84,357

[22] Filed: Aug. 10, 1987

[51] Int. Cl.[4] ..... B65D 5/72

[52] U.S. Cl. ..... 229/122.1; 229/120.24; 229/120.33; 229/123

[58] Field of Search ..... 206/44, 605, 607; 229/41 B, 104, 122.1, 120.33, 120.24, 123, 164

[56] References Cited

U.S. PATENT DOCUMENTS

| | | | |
|---|---|---|---|
| 1,799,656 | 4/1931 | Tinsley | 229/164 |
| 2,886,232 | 5/1959 | Leone | 229/122.1 |
| 2,903,180 | 9/1959 | Holmes | 229/41 B |
| 2,907,512 | 10/1959 | Leone | 229/122.1 |
| 2,942,756 | 6/1960 | Collura et al. | 229/41 B |
| 2,943,780 | 7/1960 | Bolding | 229/41 B |
| 3,536,247 | 10/1970 | Gadiel | 229/122.1 |
| 4,186,866 | 2/1980 | Zicko | 229/122.1 |
| 4,252,236 | 2/1981 | Roccaforte | 206/607 |
| 4,602,735 | 7/1986 | Aaron | 229/122.1 |
| 4,658,984 | 4/1987 | Brunner | 229/122.1 |

FOREIGN PATENT DOCUMENTS

| | | | |
|---|---|---|---|
| 2415051 | 9/1979 | France | 229/122.1 |

*Primary Examiner*—David T. Fidei

*Attorney, Agent, or Firm*—John D. Lister; Cornelius P. Quinn

[57] ABSTRACT

A display carton for bulk items having a removable portion in the front panel and a front bin wall with attached side walls immediately behind the removable portion. The front bin wall is foldably attached to the bottom panel structure so that when it is exposed it can be pulled out to reveal the contents of the carton. An automatic bottom is incorporated into the structure, allowing a flat folded and glued carton blank to be opened into carton shape.

11 Claims, 3 Drawing Sheets

CARTON WITH INTEGRAL DISPLAY BIN

FIELD OF THE INVENTION

This invention relates to display cartons, and more particularly to display cartons containing a bin which can be pulled out to display the contents of the carton.

BACKGROUND OF THE INVENTION

Some types of products are shipped to retail outlets in cartons which are designed to be used both as shipping cartons and display cartons. When selling bulk products such as candy, gum, pharmaceuticals and other small items, cartons of this type have been provided with display bins which when opened allow the customer to see the contents of the package. Although popular, the complicated structure of display bins has required them to be laboriously folded into final form by the packager, resulting in more costly packages and in a relatively low production output of filled containers. Moreover, due to inadequate carton design or improper fabrication of the carton, at times the packages are too weak to withstand the rigors of shipping and handling in addition to carrying the weight of the contents.

It would be desirable to provide a display carton having an integrally formed bin structure and an automatically formed bottom so as to increase the rate of fabrication. It would also be desirable to make the cartons more structurally sound.

BRIEF SUMMARY OF THE INVENTION

This invention overcomes the problems mentioned above by providing an inner bottom panel foldably connected to the back panel of the carton and an outer bottom panel flap which overlaps the inner bottom panel and is foldably connected to the front panel. A front bin wall is connected to and extends upwardly from the inner bottom panel adjacent the inner face of the front panel. Side bin walls are foldably connected to the front bin wall and extend rearwardly adjacent the inner face of the side panels of the carton. The front panel of the carton contains means for removing the portion of the front panel blocking the opening of the bin, and the carton further includes flaps connecting the side panels with the bottom panels to cause the bottom to automatically be formed when a folded carton blank is opened.

Other features and aspects of the invention, as well as its various benefits, will be made clear in the more detailed description of the invention which follows.

DESCRIPTION OF THE INVENTION

Figure 1:
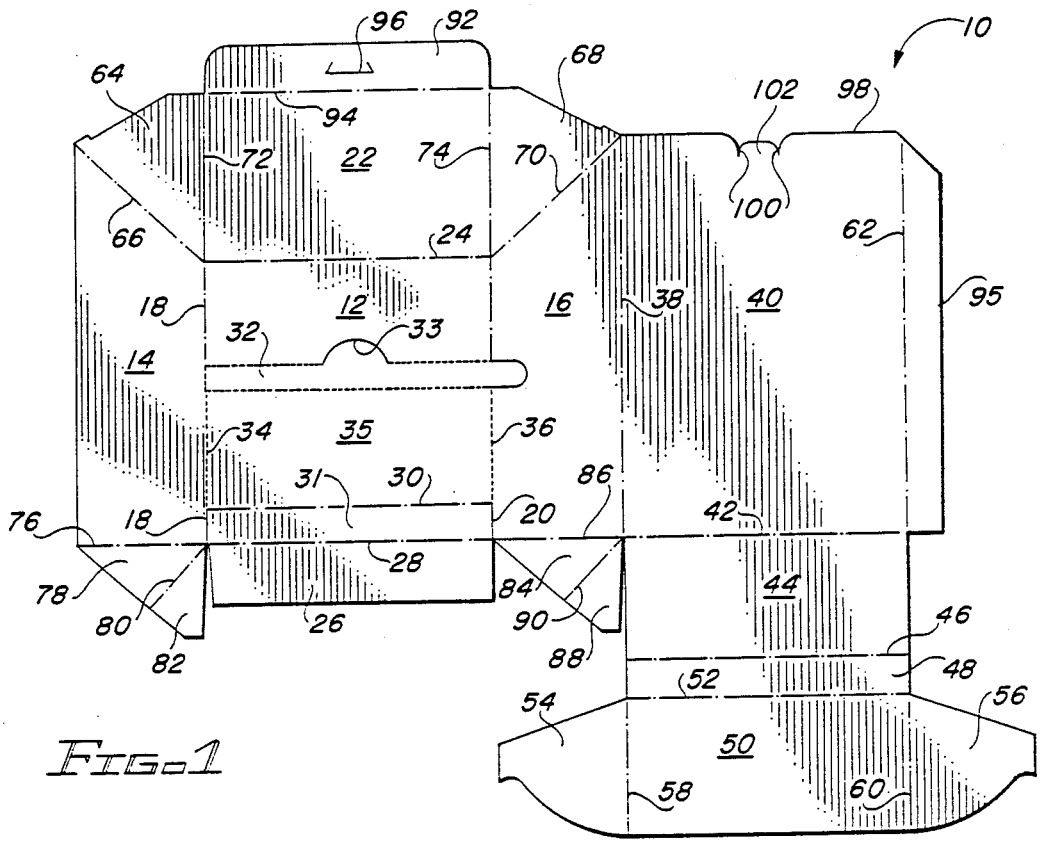
FIG. 1 is a plan view of a production blank adapted to be formed into a display bin carton of the present invention.

Referring to FIG. 1, which shows the inner surface of a production blank 10 for forming the carton of the present invention, a front panel section 12 is connected to side panel sections 14 and 16 by score lines 18 and 20, respectively. The upper edge of the front panel section is connected to a top panel section 22 by score line 24 and the bottom edge of the front panel section is connected to an outer bottom flap 26 by a score line 28. A score line 30 connects the score lines 18 and 20 a short distance above and parallel to the score line 28 to form an outer wall section 31, and a tear strip 32 extends from the score line 18 to a point slightly beyond the score line 20 in the side panel section 16. The portion of the tear strip terminating in the side panel section 16 is bounded by cut edges to enable it to be readily separated from the side panel of a carton formed from the blank and grasped when it is desired to remove the tear strip. The portions of the score lines 18 and 20 connecting the tear strip 32 and the score line 30 are weakened, as by closely spaced perforations or slits 34 and 36, respectively, to allow these portions to be separated from the front panel of a carton formed from the blank. The portion of the front panel section bounded by the tear strip 32 and the weakened score lines 34 and 36 when separated thus forms a front panel flap 35 hinged along the score line 30, the function of which will be made clear hereinafter. The upper edge of the tear strip 32 extends upwardly at about the midpoint of the front panel 12 in the form of an arcuate portion to provide a finger hole for a purpose to be explained later.

Connected to side panel section 16 by score line 38 is back panel section 40 which, as can be seen, extends upwardly a greater distance than the front panel section 12. Connected to the lower edge of the back panel section along score line 42 is inner bottom panel section 44, which contains score line 46 connecting the inner bottom panel section to inner wall section 48. Front bin wall section 50 is connected to the inner wall section 48 by score line 52, and side bin wall sections or ear sections 54 and 56 are connected to the front bin wall section 50 by score lines 58 and 60. The score line 58 is an extension of score line 38 and the left side edges of inner bottom panel section 44 and inner wall section 48. The score line 60 is an extension of score line 62, denoting the right edge of the back panel section 40, and the right side edges of the inner bottom panel section 44 and the inner wall section 48. The height of the inner wall section 48, or the distance between the score lines 46 and 52, is the same as the distance between the score lines 28 and 30 in the front panel section 12.

Still referring to FIG. 1, top closure flap 64 is connected to side panel section 14 along diagonal score line 66, and top closure flap 68 is connected to side panel section 16 along diagonal score line 70. The side edges of the top panel section 22 are separated from the top closure flaps 64 and 68 by slits 72 and 74. Connected to the lower edge of the side panel section 14 along score line 76 is bottom closure flap 78 which is connected by score line 80 to glue flap 82. The score line 80 extends from the intersection of the score lines 18, 28 and 76 at right angles to the outer edges of the flaps 78 and 82. In like manner, bottom closure flap 84 is connected to the lower edge of the side panel section 16 along score line 86 and to the glue flap 88 along score line 90. The score line 90 extends at right angles to the outer edges of the flaps 84 and 88 and continues to the intersection of the score lines 38, 42 and 86.

In addition to the foregoing structure, the top panel section 22 is connected to a closure strip 92 along score line 94, and the back panel section 40 is connected by score line 62 to a glue strip 95. The closure strip 92 contains a generally U-shaped slit 96 located in the central portion of the closure strip, and the upper edge 98 of the back panel section 40 contains spaced slits 100 forming a tab 102 therebetween. The outer edge of the tab 102 is recessed slightly from the upper edge 98 of the back panel section 40.

Figure 2:
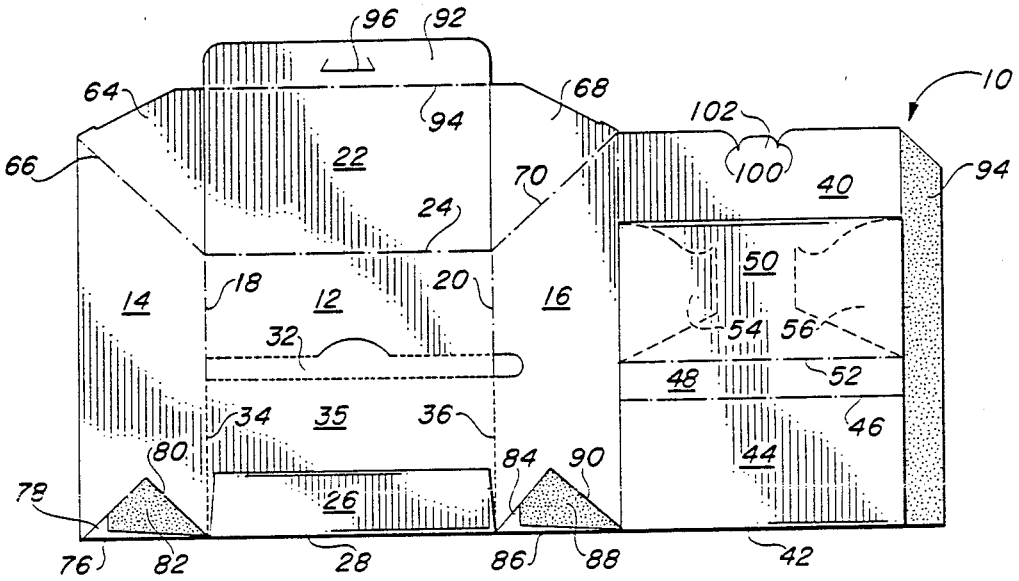
FIG. 2 is a plan view of the production blank of FIG. 1 after it has been folded to an intermediate stage in the formation of a carton.

Turning to FIGS. 1 and 2, the first step in forming a carton from the blank of FIG. 1 is to fold the side bin wall sections 54 and 56 along their score lines 58 and 60 so that the side bin wall sections overlie the front bin wall section 50. The next step is to fold back the flap 78 along score line 76, the outer bottom flap 26 along score line 28, the flap 84 along score line 86, and the inner bottom panel section 44 along score line 42. In addition, the flaps 82 and 88 are then folded back upon their adjoining flaps 78 and 84 along score lines 80 and 90, respectively. The folded carton blank at this stage appears as in FIG. 2. The stippled areas on the flaps 82 and 88 and on the glue strip 94 represent the areas of the blank to which glue is then applied.

Figure 3:
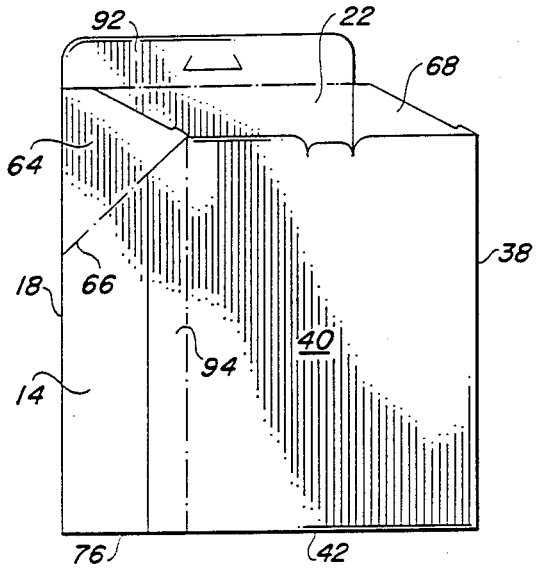
FIG. 3 is a plan view of the production blank of FIG. 1 after it has been further folded and glued to form a flattened carton.

The folded blank of FIG. 2 is then folded along score line 18 and weakened line 34 so that the side panel section 14 overlies the front panel section 12. The back panel section 40, along with folded-up sections 44 and 50, is folded along score line 38 so as to overlie top panel section 22 and front panel section 12. The resulting structure is illustrated in FIG. 3 which shows a flattened carton the side edges of which are the folds corresponding to score lines 18 and 38. The glue flap 82 will now be adhered to the folded-up outer bottom flap 26 and the glue flap 88 will be adhered to the folded-up inner bottom panel section 44. In addition, the glue strip 94 will now be adhered to the side panel section 14.

Figure 4:
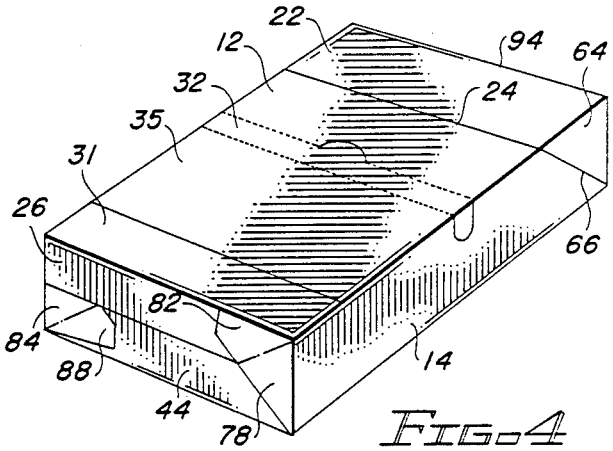
FIG. 4 is a pictorial view of a carton after it has been opened from the folded condition of FIG. 3, showing the bottom of the carton.
Figure 5:
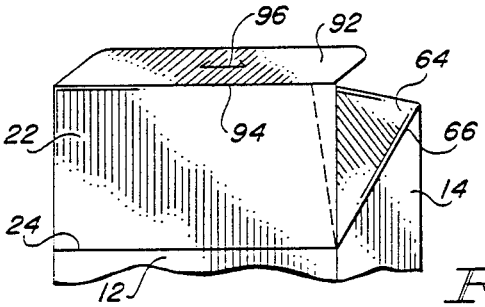
FIG. 5 is a partial pictorial view of the carton of FIG. 4, showing the front portion of the unclosed top panel of the carton.
Figure 6:
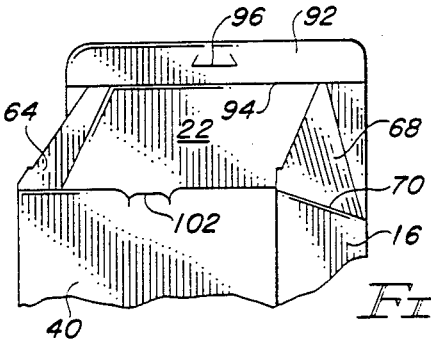
FIG. 6 is a partial pictorial view similar to that of FIG. 5, but showing the back portion of the unclosed top panel of the carton.

Semi-formed carton blanks in the form of the flattened and glued carton blank of FIG. 3 are shipped to the packager where they are opened by pressing the outermost folds 18 and 38 toward each other, causing a pivoting action of the various panel sections about their score lines, resulting in the box-shaped carton of FIGS. 4–6. As illustrated in FIG. 4, the bottom of the carton comprises inner bottom panel 44 adhered to glue flap 88 and overlapping outer bottom panel flap 26 adhered to glueflap 82. The bottom of the carton is thus automatically formed by gluing the flaps as described and then opening the semi-formed carton blank. As shown best in FIGS. 5 and 6, the top panel 22 is not closed and the closure flaps 64 and 68 have not been folded along score lines 66 and 70 but are still in the form of extensions of side panels 14 and 16. The packager at this point fills the carton with the desired bulk products and the top panel is closed by first folding down the flaps 64 and 68 and then folding down the top panel 22 so that the closure strip 92 slides along the inside surface of the top portion of the back panel 40. The tab 102 is adapted to fit into the slit 96 to hold the top panel or lid securely in place.

Figure 7:
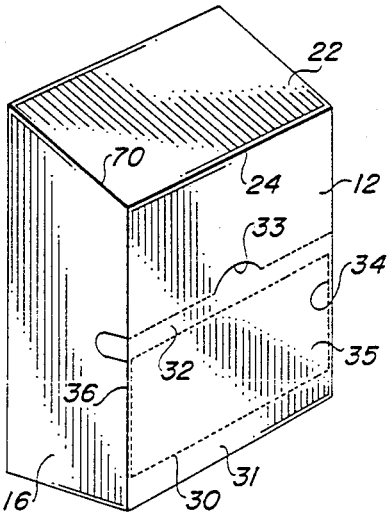
FIG. 7 is a pictorial view of the closed carton of the present invention.
Figure 8:
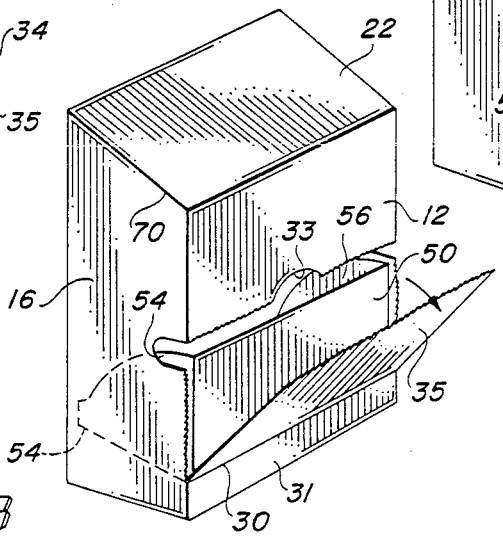
FIG. 8 is a pictorial view of the carton of FIG. 7 after the tear strip has been removed and the front panel flap has been opened.

The completed and filled package appears as shown in FIG. 7, wherein the tear strip 32 is intact and the weakened lines 34 and 36 are still unbroken, leaving a continuous surface comprised of panel 12, tear strip 32, front panel flap 35 and outer wall portion 31. To set up the display it is merely necessary to remove the tear strip and pull down on the front panel flap 35 to tear the edges 34 and 36. The front panel flap 35, now being connected only at the score line 30, can be folded about the score line 30 to the open position shown in FIG. 8. The front bin wall 50 is located immediately behind the front panel flap and the side bin walls or ears 54 and 56 can be seen to extend back along the inner surface of the adjacent side panels.

Figure 9:
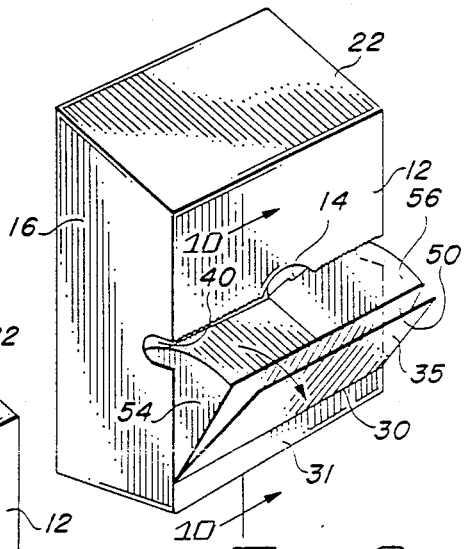
FIG. 9 is a pictorial view similar to that of FIG. 8, but showing the bin after it has been pulled out.
Figure 10:
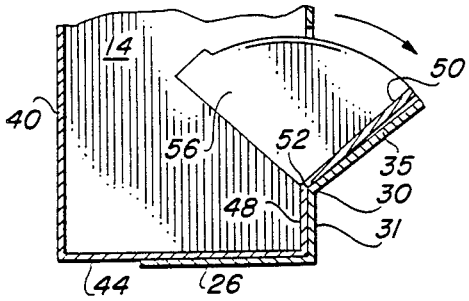
FIG. 10 is a partial transverse sectional view taken on line 10—10 of FIG. 9.

By grasping the top edge of the front bin wall 50 through the finger hole 33 the bin can be pivoted down about its score line 52 to the position shown in FIGS. 9 and 10. The score line 52 of the bin is located substantially even with the score line 30 of the front panel flap so that the front bin wall can be folded down through the space previously occupied by the front panel flap. Although the contents of the carton are not shown in the drawings it can be seen that they would be visible and accessible through the open bin configuration.

If desired, the front panel flap can be connected at its lower edge along a weakened line instead of the score line 30 so that the front panel flap can be removed entirely. This would be done primarily if it is determined that the flap should be removed for aesthetic purposes. It is preferred to keep it connected as described above, however, for the additional support it provides when the front bin wall is pulled out and is filled with the bulk articles from within the carton.

In the design shown in FIGS. 1–10, the bin is spaced above the bottom panel of the carton by the height of the wall portion 48. The result of this arrangement is that the contents of the carton, when the carton is almost empty, will lie below the lower edge of the front bin wall and may not at that point be as conveniently accessible as desired. This condition can be alleviated by extending the lower edges of the front panel flap 35 and the front bin wall 50 down close to or at the bottom panel. Since it is preferred, however, for structural and aesthetic reasons, to maintain the front panel flap and the front bin wall in the locations shown, access to the bottom of the carton can be improved by utilizing an elevated platform insert.

Figure 11:
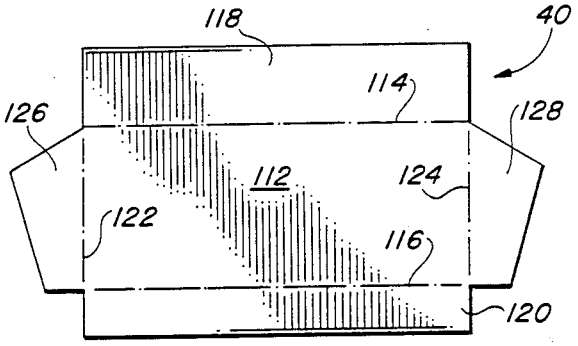
FIG. 11 is a plan view of a blank for forming a bottom platform insert.
Figure 12:
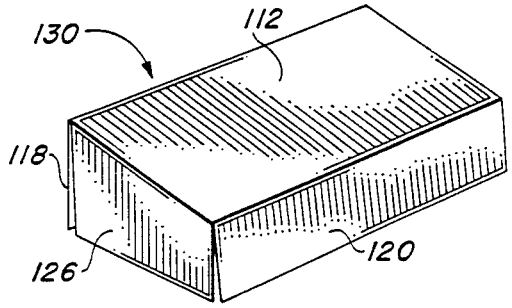
FIG. 12 is a pictorial view of a platform insert formed from the blank of FIG. 11.

Referring to FIG. 11, a blank 110 is shown comprising a platform section 112 connected by score lines 114 and 116 to back and front flaps 118 and 120, respectively. Score lines 122 and 124 further connect the platform section to side flaps 126 and 128. The back flap 118 extends out from the platform section a greater distance than does the front flap 120, and the back portions of the side flaps extend a greater distance away from the score lines 122 and 124 than do the front portions. This configuration, when the flaps are folded down about the score lines, results in the platform insert 130 shown in FIG. 12, wherein the platform panel 112 is sloped downwardly from the back of the carton toward the front. The platform insert, which is dimensioned so as to fit fairly snugly in the bottom of the carton, is simply dropped or pushed to the bottom of the carton after the blank has been opened into the intermediate form of FIGS. 4–6 but before the carton has been filled.

Figure 15:
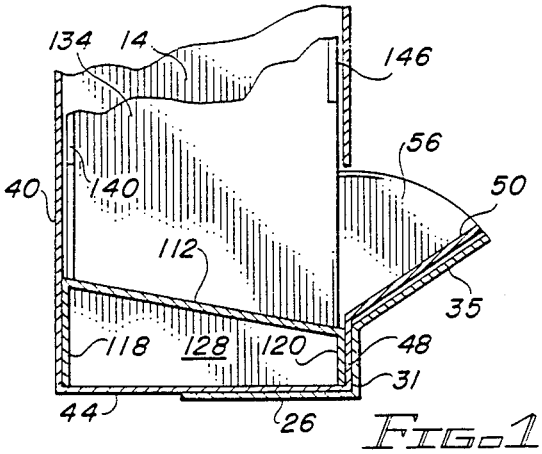
FIG. 15 is a partial transverse sectional view similar to that of FIG. 10, but showing the carton with the bottom platform insert and the divider insert in place.

The platform insert is shown in place in FIG. 15. In that arrangement the height of the front flap 120 corresponds to the height of wall portion 48 and causes the contents of the carton to flow forwardly toward the open front bin wall.

Figure 13:
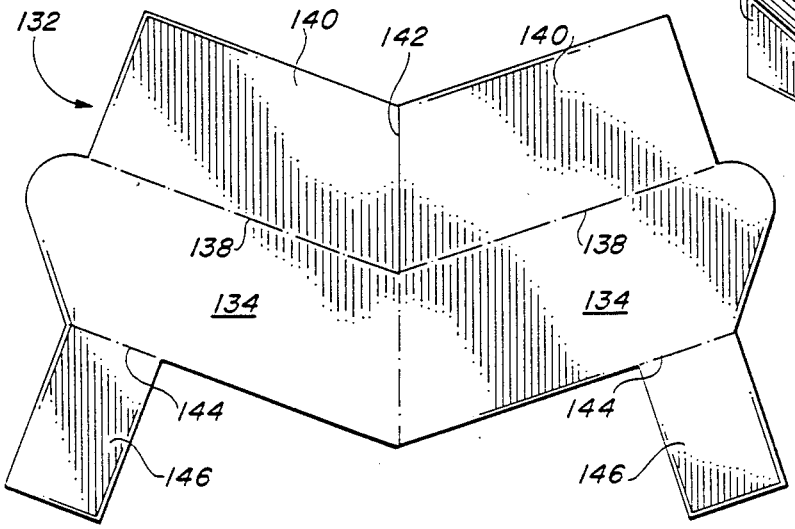
FIG. 13 is a plan view of a blank for forming a carton divider insert.

It is also possible to provide a divider insert to separate the carton into different compartments so as to segregate different types of articles inside the carton. For example, such a divider could be used to separate two different flavors of candy packaged in the same carton. A blank 132 for forming a divider insert capable of performing this function is shown in FIG. 13 as comprising identical central divider sections 134 connected by score line 136. Connected to the back edges of divider sections 134 by score lines 138 are back flaps 140 separated by slit 142. Connected to the front edges of the divider sections 134 by score lines 144 are front flaps 146.

Figure 14:
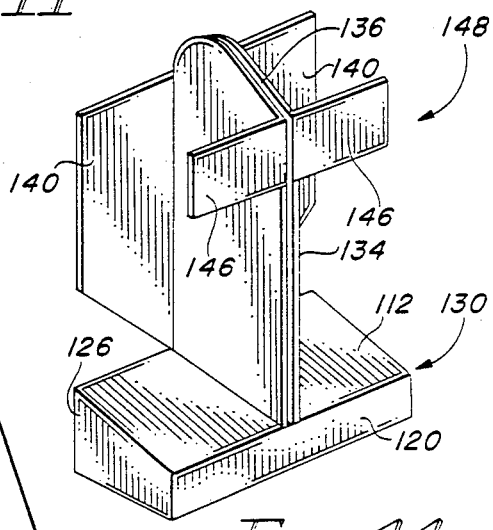
FIG. 14 is a pictorial view of a carton divider insert formed from the blank of FIG. 13.

When folded along the score lines 136, 138 and 144, the blank 132 is formed into the divider insert 148 shown in FIG. 14. The central divider sections 134 are thus face to face, with the score line 136 joining them at the top edge of the divider. The back flaps 140 when folded out as shown are adapted to engage the back panel of the carton, and the front flaps 146 when folded out are adapted to engage the front panel of the carton. The back flaps are relatively long to enable them to contact the inside face of the back panel of the carton throughout the length of the divider and thereby provide maximum support. The front flaps are relatively short, enabling them to contact the inside face of the front panel of th carton above the front flap 35 so as not to interfere with the opening of the front flap or with the movement of the bin. As shown in FIG. 14, the bottom edge of the combined central divider sections is angled to abut the sloped platform panel 112. Like the platform insert, the divider 148 is inserted through the open end of the carton prior to filling the carton.

Figure 16:
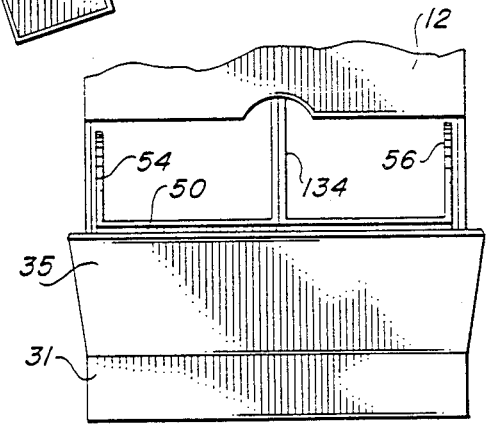
FIG. 16 is a partial front view showing the lower portion of the carton of FIG. 15.

As shown in FIGS. 15 and 16, the central wall 134 of the divider insert effectively divides the interior of the carton into two compartments for receiving two different types of articles. It does not interfere with the movement of the front and side bin walls, nor does it interfere with the function of the sloped platform.

It should now be clear that the present invention provides a display bin carton which can be formed from a single blank in a very simple yet highly efficient manner. The blank can be shipped as a folded semi-formed carton and the packager can readily open it to enable the blank to automatically form the bottom panel of the carton. At that point the carton can be filled and the top panel closed, or a platform insert and divider insert can first be inserted in order to obtain the functions discussed above. The carton is structurally sound, particularly due to the bottom panel arrangement and the front panel and bin arrangement, and functions readily and easily to ship and display the articles it contains.

It should be obvious that although a preferred embodiment of the invention has been disclosed, changes to certain of the details of the embodiment may be made without departing from the spirit and scope of the invention as defined in the claims.

What is claimed is:

1. A carton having an integral display bin, comprising:

a front panel;

a back panel;

side panels foldably connected to the front and back panels;

a carton bottom comprising an inner bottom panel foldably connected to the back panel and an outer bottom panel flap foldably connected to the front panel and overlapping the inner bottom panel;

means connecting the side panels to the inner bottom panel and to the outer bottom panel flap, said means causing the bottom to automatically be formed when a folded carton blank is opened;

foldable connection means connecting a front bin wall to the inner bottom panel, the front bin wall extending from the foldable connection means adjacent the inside surface of the front panel;

side bin walls foldably connected to the front bin wall and extending rearwardly therefrom adjacent the inside surface of the side panels; and means permitting a portion of the front panel to be removed to form an opening through which the front bin wall can be pivoted down about the foldable connection means, enabling the front bin wall and at least portions of the side bin walls to be pulled out from the carton to display the contents of the carton.

2. A carton having an integral display bin according to claim 1, wherein the means connecting the side panels to the inner bottom panel and to the outer bottom panel flap comprises a first flap foldably connected to one of the side panels and a second flap foldably connected to the other side panel, a portion of the first flap being glued to the inner bottom panel and a portion of the second flap being glued to the outer bottom panel flap, the first flap containing a fold line separating the glued portion thereof from the remainder of the first flap and the second flap containing a fold line separating the glued portion thereof from the remainder of the second flap.

3. A carton having an integral display bin according to claim 1, wherein the foldable connection means connecting the front bin wall and the inner bottom panel further comprises a wall portion foldably connected to the inner bottom panel and extending upwardly therefrom, the front bin wall being foldably connected to the wall portion.

4. A carton having an integral display bin according to claim 1, wherein the means permitting a portion of the front panel to be removed comprises a lower generally horizontally disposed fold line in the front panel and weakened lines in the front panel connecting the extremitities of the lower fold line, whereby when the front panel is separated along the weakened lines the panel area bounded by the weakened lines and the lower fold line can be folded down about the lower fold line.

5. A carton having an integral display bin according to claim 4, wherein the lower fold line extends substantially across the width of the front panel and the weakened lines comprise portions of the side edges of the front panel extending upwardly from the lower fold line and terminating below the top of the front bin wall.

6. A carton having an integral display bin according to claim 5, wherein the weakened lines further comprise a tear strip connecting the upper ends of the weakened portions of the side edges of the front panel.

7. A carton having an integral display bin according to claim 3, wherein the means permitting a portion of the front panel to be removed comprises a lower generally horizontally disposed fold line in the front panel generally aligned with the foldable connection between the front bin wall and the wall portion, and weakened lines in the front panel connecting the extremities of the lower fold line, whereby when the front panel is separated along the weakened lines the area bounded by the weakened lines and the lower fold line can be pivoted down about the lower fold line and the display bin can be pulled outwardly of the front panel.

8. A production blank for forming a carton having an integral display bin, comprising:

a generally rectangular front panel section having side edges, an upper edge and a bottom edge;

a generally rectangular back panel section having side edges, an upper edge and a bottom edge;

a first side panel section connected to one of the side edges of the front panel section by a fold line;

a second side panel section connected to the other side edge of the front panel section by a fold line and to one of the side edges of the back panel section by a fold line;

an inner bottom panel section connected to the bottom edge of the back panel section by a fold line;

an outer bottom panel flap section connected to the bottom edge of the front panel section by a fold line and adapted to overlap the inner bottom panel of a carton formed from the blank;

each of the side panel sections being connected by a fold line to a flap, one of the flaps being adapted to be glued to the outer face of the inner bottom panel of a carton formed from the blank and the other flap being adapted to be glued to the outer face of the outer bottom panel flap of the carton;

a front bin wall section connected to the inner bottom panel section by fold line means;

side bin wall sections connected to the front bin wall section by fold lines; and tear means outlining a portion of the front panel section which is intended to be adjacent the front bin wall of the carton, the tear means enabling said portion of the front panel of a carton formed from the blank to be moved out of the way to permit the bin to be moved outwardly of the front panel of the carton.

9. A production blank according to claim 8, wherein each of the flaps connected to the side panel sections contains a fold line enabling the flaps to be folded back upon themselves, the portion folded back on one of the flaps being adapted to be glued to the inner bottom panel section after the inner bottom panel section has been folded back to overlie the back panel section and the back panel section has been folded to overlie the seecond side panel section, the portion folded back on the other flap being adapted to be glued to the outer bottom panel flap section after the outer bottom panel flap section has been folded back to overlie the front panel section and the first side panel section has been folded to overlie the front panel section, the blank further including means for attaching the other side edge of the back panel section to the first side panel section, whereby the thus folded and glued blank can be opened into carton form.

10. A production blank according to claim 8, wherein the fold line means connecting the front bin wall section to the inner bottom panel section comprises a front wall section one edge of which is connected to the bottom panel section by a fold line and an opposite edge of which is connected to the front bin wall section by a fold line.

11. A carton having an integral display bin according to claim 3, including platform means inside the carton, the platform means having an upper support surface for supporting the contents of the carton, the upper support surface being adjacent the foldable connection between the front bin wall and the wall portion.

* * * * *